United States Patent [19]

Halchek

[11] Patent Number: 4,471,752

[45] Date of Patent: Sep. 18, 1984

[54] WOOD BURNING STOVE

[76] Inventor: Joseph Halchek, Village Hill Rd., Stafford Springs, Conn. 06076

[21] Appl. No.: 428,428

[22] Filed: Sep. 29, 1982

[51] Int. Cl.[3] ..... F24C 1/14

[52] U.S. Cl. ..... 126/77; 126/112

[58] Field of Search ..... 126/66, 77, 126, 193, 126/296, 400, 163 R, 108, 146, 112; 110/147

[56] References Cited

U.S. PATENT DOCUMENTS 777,139 12/1904 Reagan ..... 110/147

4,319,556 3/1982 Schwartz ..... 126/163 R

FOREIGN PATENT DOCUMENTS 220152 3/1942 Switzerland ..... 126/77

*Primary Examiner*—Samuel Scott

*Assistant Examiner*—G. Anderson

[57] ABSTRACT

A wood burning stove having improved air flow characteristics for effective combustion and purging of gaseous combustion by-products. A primary air inlet is provided below the loading door of the stove for feeding air to the firebox proper for combustion. A plurality of opposing supplementary air inlets are provided in opposite sides of the stove, at least two of the supplementary inlets being on the level of the primary air inlet, for introducing air into the firebox supplemental to the air flow through the primary inlet.

8 Claims, 4 Drawing Figures

20
10
30
36
34
32
24
18
14
16
22
26
50
54
12
50

10
20
18
50
50
42
46
52

10
20
18
50
50
50
50

WOOD BURNING STOVE

BACKGROUND OF THE INVENTION

The present invention relates to a wood burning stove and, more particularly, a wood burning stove having improved air flow characteristics for effective combustion and purging of gaseous combustion by-products.

With ever increasing costs in the conventional fuels, particularly oil and gas, it has become quite common for individuals to employ wood burning stoves as a source of primary or supplemental heat. Wood is generally available at costs below oil and gas. Presently, commercially available wood burning stoves have the same burning characteristics and require dry wood to operate effectively. These stoves have an air intake at the lower front of the stove and an exhaust at the top. At low burn rates a positive back pressure is built up in presently available stoves which alters the air flow patterns in the stove and affects the burn cycle. Theoretically, a stove is most inefficient when in this nearly airless mode and a number of significant disadvantages are encountered. Firstly, a low burning fire usually produces a high level of creosote, a distillate of hydrocarbons and water, which is extremely undesirable from a safety standpoint. Secondly, the stoves are incapable of burning "green" wood. Thirdly, a high percentage of the thermal energy is lost through the flue gases.

There is a long-standing desire for a wood burning stove having improved combustion characteristics. The stove should be able to burn both dry and green wood with a minimum of creosote formation and with good combustion efficiency at both high and low burn rates.

Accordingly, it is a principal object of the present invention to provide a wood burning stove having improved air flow characteristics for effective combustion.

It is a particular object of the present invention to provide a wood burning stove having improved air flow characteristics which is capable of burning both dry and "green" wood.

It is a still further object of the present invention to provide a wood burning stove having improved air flow characteristics wherein primary air is provided for effective combustion and supplemental air is provided for aiding in the purging of gaseous combustion by products.

Further objects and advantages of the present invention will appear hereinbelow.

SUMMARY OF THE INVENTION

In accordance with the present invention, the foregoing objects and advantages are readily obtained.

The present invention relates to a wood burning stove and, more particularly, a wood burning stove having improved air flow characteristics for effective combustion and purging of gaseous combustion by-products. In accordance with the present invention, a primary air inlet is provided below the loading door of the stove for feeding air to the firebox proper for combustion. A plurality of opposing supplemental air inlets are provided on either side of the primary air inlet for introducing air into the firebox proper at substantially right angles to the air supplied through the primary inlet. The air entering the firebox through the supplemental air inlets, which in the preferred embodiment are located at different heights, creates an efficient purging and outflow of the gaseous combustion by-products. The heating and expansion of the air supplied through the supplemental inlets creates a slight negative pressure in the firebox proper and, as a result of the flow of this supplemental inlet air, there is an increase in velocity and swirling turbulent flow of the air entering the primary inlet. As a result of the foregoing, the combustion process is enhanced to the point where green, unsplit wood can be burned at low rates with little creosote production. The stove of the present invention may be used in combination with hot water boiler systems, hot air systems and passive convection/radiation systems.

In accordance with the present invention, wood, whether green or dry, is effectively burned in an efficient manner. The wood is burnt at low burn rates with little creosote production.

DETAILED DESCRIPTION

For purposes of discussion, the present invention is illustrated and will be described in combination with a hot water boiler system. It should be appreciated that the wood stove of the present invention has other applications such as a hot air system or passive convection/-radiation system without departing from the principles described herein.

Figure 1:
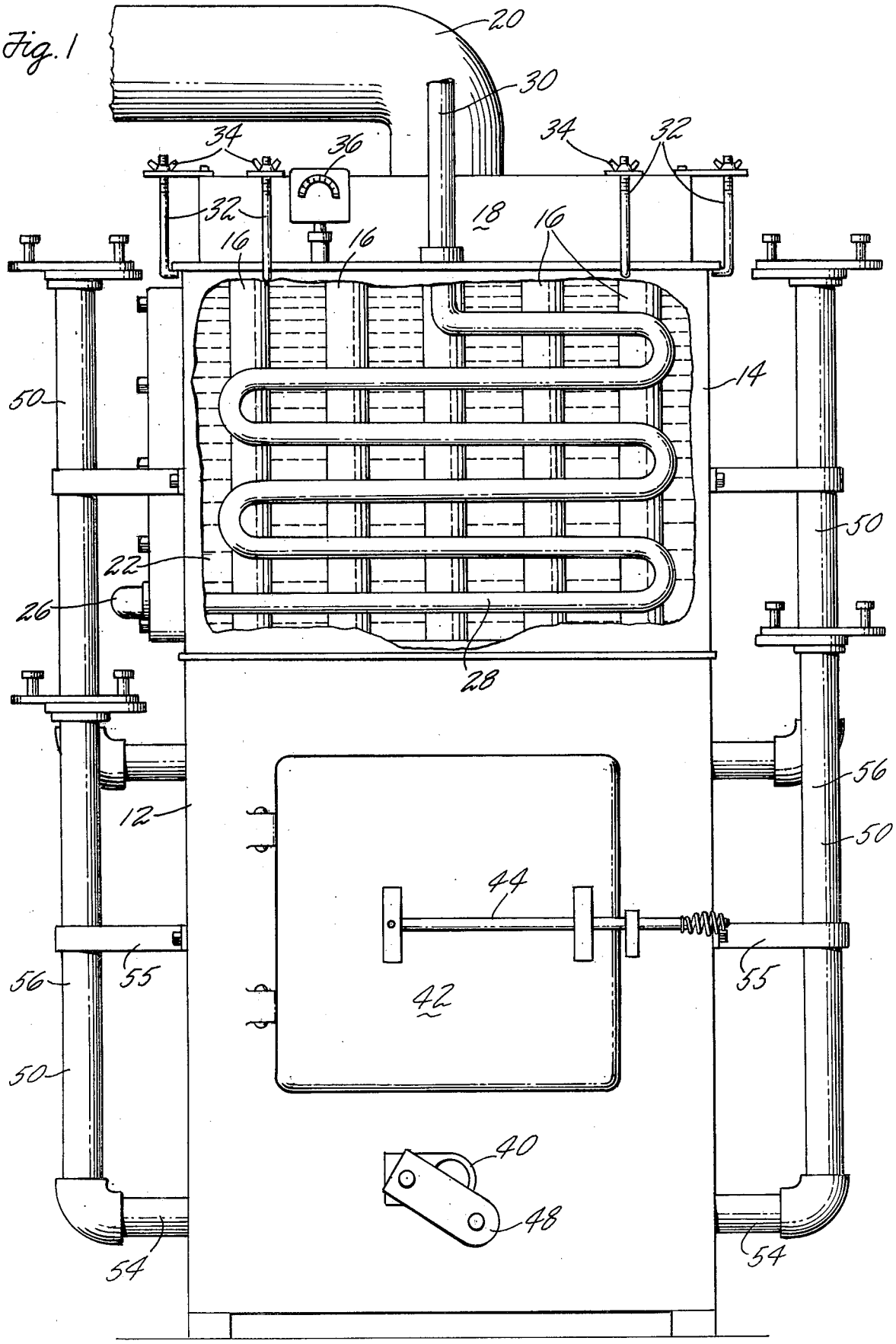
FIG. 1 is a partially sectioned front view of a wood stove in accordance with the present invention illustrated in combination with a hot water boiler system.
Figure 2:
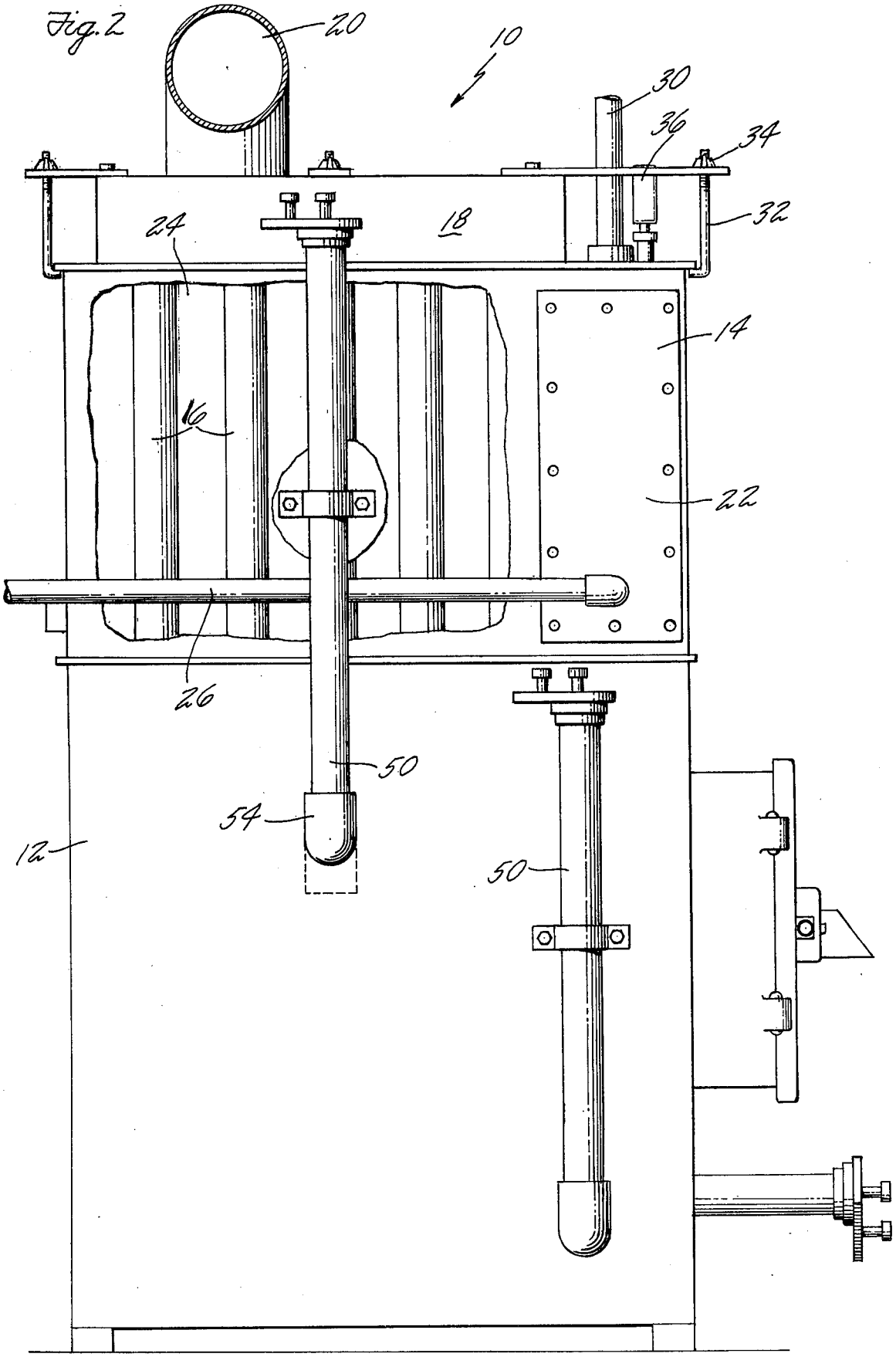
FIG. 2 is a partially sectioned side view of the wood stove of FIG. 1.

Referring to the drawings, a hot water boiler system 10 is illustrated and comprises a wood burning stove section 12 and a water heating section 14. As can be seen in FIGS. 1 and 2, water heating section 14 is provided with a plurality of exhaust pipes 16 communicating the firebox proper of stove section 12 with an exhaust gas manifold 18 for carrying the combustion gas from the stove. Manifold 18 feeds the combustion gas to exhaust conduit 20. Manifold 18 is secured in place on top of water heating section 14 by means of flange bolts 32 and nuts 34.

Water heating section 14, as illustrated, may be divided into a first chamber 22 for heating water and a second chamber 24 which may be used for heating air by means of a wall, not shown. It should be appreciated that section 14 might remain a single water heating chamber if desired. In the system illustrated, water is delivered to chamber 22 via water inlet pipe 26 and travels in a serpentine pipe 28 exiting chamber 22 via water outlet pipe 30. Chamber 22 may, if desired, contain a suitable fluid medium so as to enhance heat exchange between the exhaust pipes 16 and serpentine pipe 28. A pressure guage 36 is provided so as to monitor the build-up of pressure in chamber 22.

With further reference to the drawings, the wood burning stove of the present invention will be discussed in detail. A primary air inlet pipe 40 is provided below loading door 42 of the stove section 12 for feeding air to the firebox proper for combustion. Door 42 is provided with a pivotably mounted latch 44 for securing the door 42 in its closed position in notch 46. Inlet pipe 40 is provided with a rotably mounted damper 48 for controlling the volume of air entering inlet 40. In accordance with the principle features of the present invention, a plurality of additional air inlet pipes 50 are provided on the opposed sidewalls 52 of firebox 12 for introducing supplemental air into the firebox. The portion of each of supplemental air inlet pipes 50 located to the exterior of the stove are L-shaped in configuration having a base portion 54 and a leg portion 56 which is provided, at its open upper end, with a pivotably mounted damper 58 for controlling the volume of air flow in pipes 50. Pipes 50 are held in place on sidewalls 52 by means of brackets 55.

Figure 3:
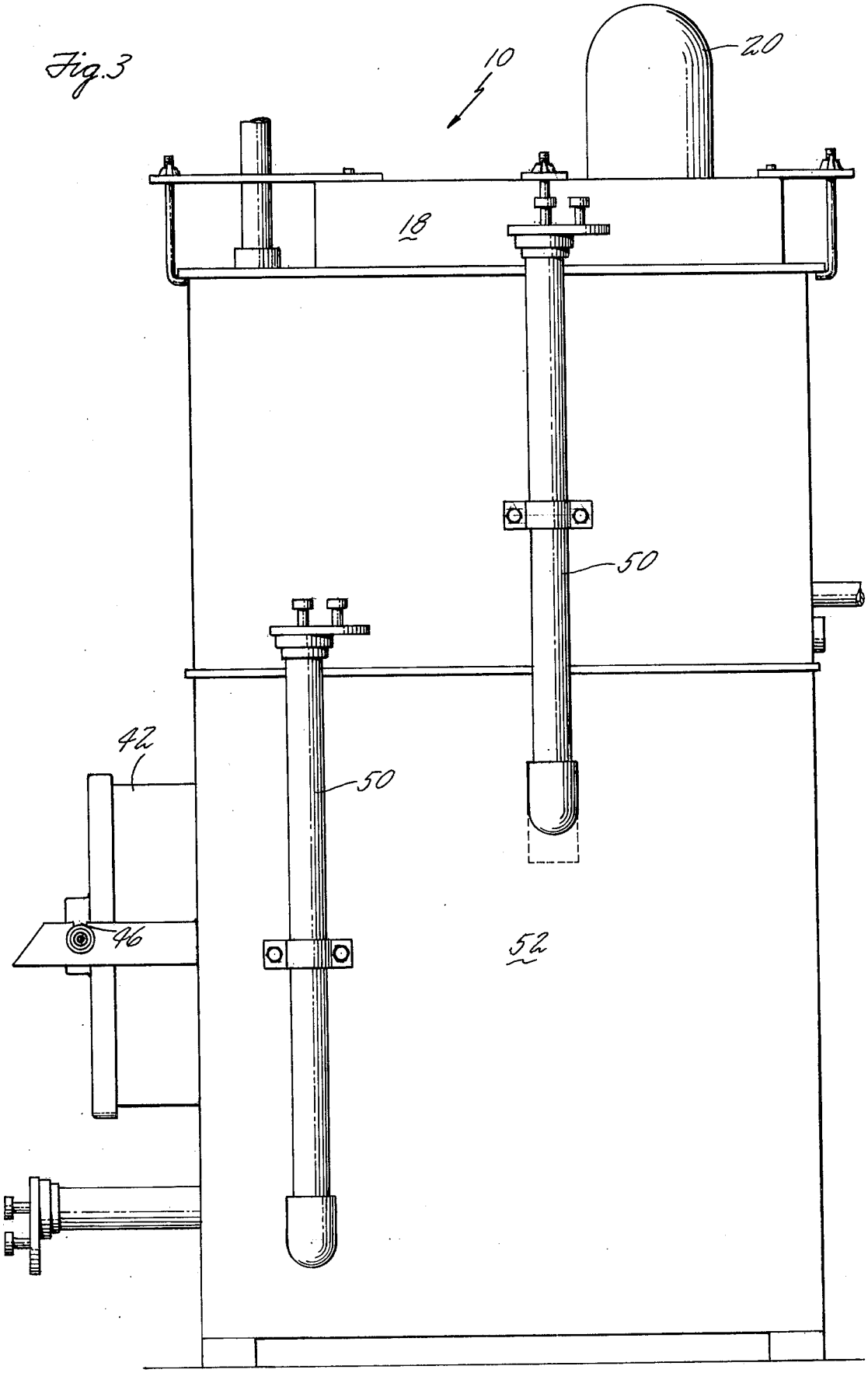
FIG. 3 is another side of the wood stove of FIG. 1.
Figure 4:
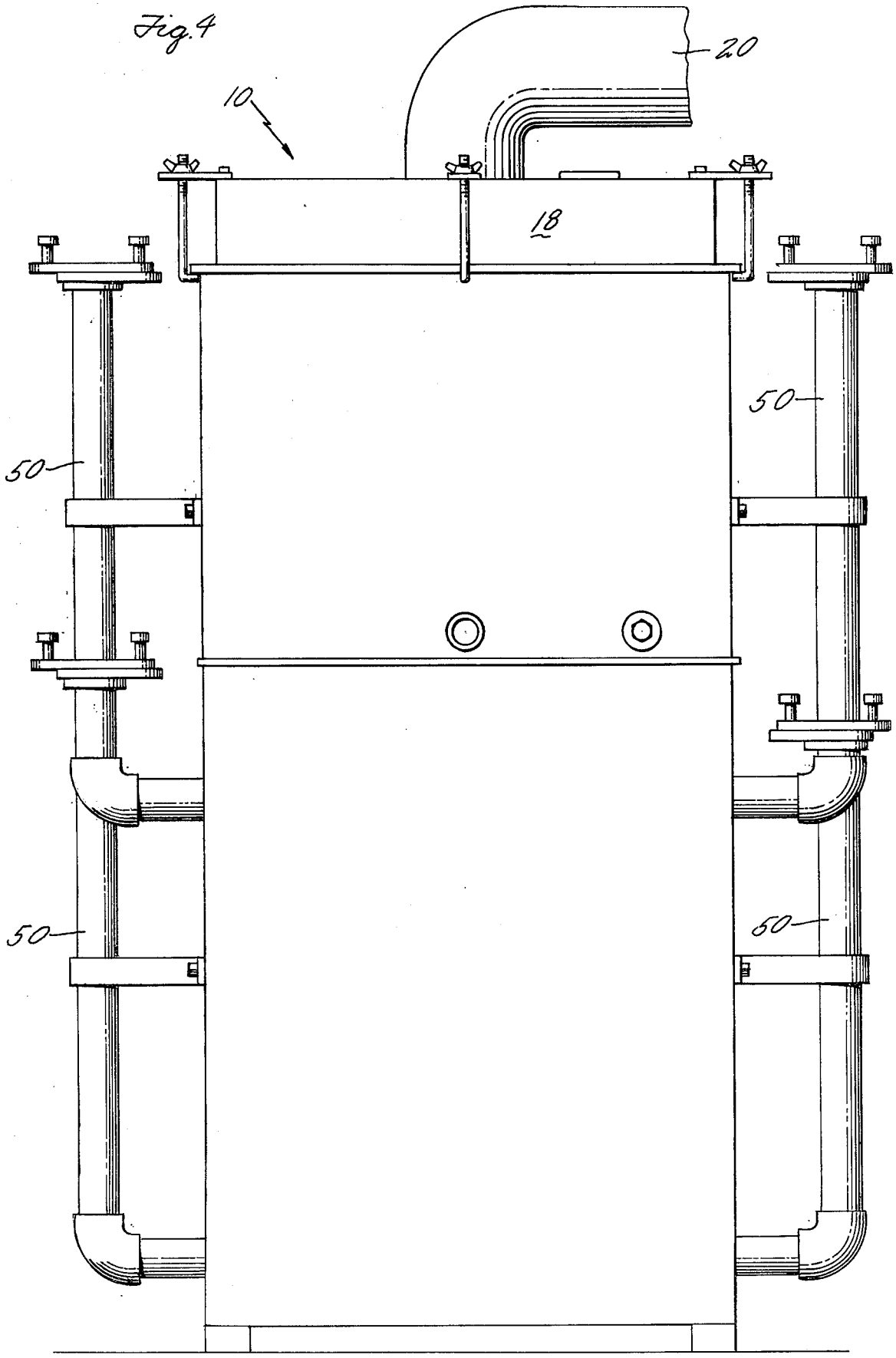
FIG. 4 is a rear view of the wood stove of FIG. 1.

Air entering the firebox through the supplemental inlet pipes 50 creates an efficient purging and outflow of the gaseous combustion by-products. The exiting gases create a slight negative pressure from the firebox proper which results in an increase in velocity and swirling turbulent flow of the primary air entering the primary inlet 40 provided below the loading door 42. In accordance with the present invention, it is preferred that the air inlet pipes 50 on sidewalls 52 be laterally spaced. As can best be seen in FIGS. 2 and 3, it is preferred that the inlet pipes 50 located closest to loading door 42 be positioned so as to discharge into the firebox at about the same height as the primary air inlet and in a direction which is transverse to the direction of primary air flow. The air inlet pipes 50 which are farthest from loading door 42 should be at the same level, at a height which places them near the top of the stove section 12 and, as may be seen from FIGS. 2 and 3, preferably discharge through elbows into the firebox in a direction which is different from the discharge direction of the lower supplemental air inlets. The providing of the additional air inlets, i.e., the pipes 50, at the specified lateral locations and heights results in improved air flow characteristics thus resulting in effective combustion and purging of gaseous combustion by-products.

In accordance with a further feature of the present invention, the leg portions 56 of the pipes 50 closest to the loading door 42, i.e., the lower additional air inlet supply pipes, extend upwardly to about the top of firebox 12 while the upper additional supply conduits extend to a height approximately equal to the top of the water heating section 14 in a preferred embodiment. It is essential that pipe portions 56 be of sufficient length and be angularly oriented so that a temperature differential, and thus a pressure differential, exist thereacross so that air will flow down the pipes into the stove rather than smoke escaping through the pipes. By placing the supplemental inlet pipes 50 in the manner specified above, a slight negative pressure is created in the firebox proper which results in an increase in the velocity of the primary air entering through primary inlet 40 below loading door 42. The increase in velocity increases the amount of air which contacts the burnable substrate per unit of time thereby allowing for more effective combustion. In addition to increasing the velocity of the primary air entering the firebox, the air flows in a swirling turbulent manner thereby further enhancing the combustion process.

In summary, it is believed that the present invention causes a transition from laminar flow to turbulent flow of the air entering the firebox through the primary inlet. The increased velocity and swirling flow of the air enhances the combustion process to a degree which could not be achieved without the use of supplemental air inlets located at two levels in the firebox side walls.

It is to be noted that the discharge from the upper supplemental supply pipes is, in the disclosed embodiment, downwardly toward the hearth. Additionally, a restriction or other flow disturbance causing means may be incorporated in the lower supplemental supply pipes adjacent the discharge ends thereof.

By way of the present invention, wood, whether green or dry, is effectively burned in an efficient manner. The wood is burned at low burn rates with little creosote production.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A wood burning stove having improved airflow characteristics for effective combustion and purging of gaseous combustion by-products comprising a firebox having a generally cubical shape, a loading door opening into said firebox through the front side of said wall thereof, an adjustable primary air inlet positioned below said loading door for continuously feeding primary air in a first direction to the firebox to support combustion therein, exhaust means for discharging the gaseous exhaust products resulting from combustion of a wood fuel within said firebox, at least a first pair of supplemental air inlets for introducing air into said firebox in a direction substantially normal to the direction of feed of the primary air introduced through said primary air inlet, the supplemental air inlets of said first pair respectively being provided in opposite side walls of said firebox at substantially the same level as said primary air inlet, at least a second pair of supplemental air inlets for introducing air into said firebox, the inlets of said second pair of supplemental air inlets being respectively provided in said opposite side walls of said firebox, said second pair of supplemental air inlets being located above said primary air inlet, said air inlets of said second pair of supplemental air inlets respectively introducing air into said firebox in a direction which is different from the primary air feed direction and the direction of introduction of air through the inlets of said first pair of supplemental air inlets, and means for establishing a pressure differential between the source of the supplemental air and said supplemental air inlets whereby the supplemental air will flow through said inlets and into said firebox.

2. A wood burning stove according to claim 1 wherein said supplemental air inlets are provided with dampers.

3. A wood burning stove according to claim 2 wherein a water heating section is provided above said firebox and said exhaust means is positioned within said water heating section.

4. A wood burning stove according to claim 3 wherein serpentine pipe is positioned within said water heating section for receiving water to be heated.

5. A wood burning stove according to claim 1 wherein each of said supplemental inlets includes a supply pipe which extends upwardly with respect to the primary inlet.

6. A wood burning stove according to claim 5 wherein said supplemental air inlets are provided with dampers.

7. A wood burning stove according to claim 6 wherein said inlets of said first pair of supplemental air inlets are laterally offset with respect to the inlets of said second pair of supplemental air inlets.

8. A wood burning stove according to claim 7 wherein said second pair of supplemental air inlets discharge generally downwardly.

* * * * *